US007124688B2

(12) United States Patent
Avetisian et al.

(10) Patent No.: US 7,124,688 B2
(45) Date of Patent: Oct. 24, 2006

(54) OVERMOLDED BODY FOR PYROTECHNIC INITIATOR AND METHOD OF MOLDING SAME

(75) Inventors: Vahan Avetisian, Newbury Park, CA (US); Paul Berg, Chatsworth, CA (US); Robert Renz, Newbury Park, CA (US); George Karloff, Newhall, CA (US)

(73) Assignee: Special Devices, Inc., Moorpark, CA (US)

( * ) Notice: Subject to any disclaimer, the term of this patent is extended or adjusted under 35 U.S.C. 154(b) by 216 days.

(21) Appl. No.: 09/733,813

(22) Filed: Dec. 8, 2000

(65) Prior Publication Data

US 2002/0069783 A1 Jun. 13, 2002

(51) Int. Cl.
*F42B 3/10* (2006.01)
*F42B 3/12* (2006.01)
*F42C 19/12* (2006.01)

(52) U.S. Cl. ..... 102/202.7; 102/202.9; 102/202.14

(58) Field of Classification Search ..... 102/202.1, 102/202.2, 202.5, 202.7, 202.8, 202.9, 202.14, 102/202.3, 202.4, 202.6, 202.11, 202.12, 102/202.13, 530, 531; 86/1.1; 280/741
See application file for complete search history.

(56) References Cited

U.S. PATENT DOCUMENTS 936,227 A * 10/1909 Fay ..... 102/202.8
1,215,329 A * 2/1917 Allison ..... 102/202.5
2,741,179 A * 4/1956 Taylor et al. ..... 102/202.7
2,968,985 A * 1/1961 Seavey ..... 86/1.1
3,198,678 A * 8/1965 Zeman et al. ..... 102/202.7
3,906,858 A * 9/1975 Craig et al. ..... 102/202.7
3,971,320 A * 7/1976 Lee ..... 102/202.9
5,576,509 A * 11/1996 Refouvelet et al. ..... 102/202.7
5,621,183 A * 4/1997 Bailey ..... 102/202.7
5,821,446 A * 10/1998 Chatley, Jr. ..... 102/202.14
5,932,832 A * 8/1999 Hansen et al. ..... 102/202.9
6,009,809 A * 1/2000 Whang ..... 102/202.14
6,073,963 A * 6/2000 Hamilton et al. ..... 102/202.14
6,167,808 B1 * 1/2001 Mramor ..... 102/202.9
6,274,252 B1 * 8/2001 Naugler et al. ..... 428/621
6,295,935 B1 * 10/2001 Swann et al. ..... 102/202.14
6,763,764 B1 * 7/2004 Avetisian et al. ..... 102/202.14

FOREIGN PATENT DOCUMENTS

DE 3922938 A1 * 1/1991

* cited by examiner

*Primary Examiner*—Michael J. Carone
*Assistant Examiner*—James S. Bergin
(74) *Attorney, Agent, or Firm*—Law Offices of Thomas J. Brindisi

(57) ABSTRACT

A pyrotechnic initiator with an integral, unitary, overmolded insulating body that eliminates the need for separate components to form the body, and the method of molding same.

20 Claims, 1 Drawing Sheet

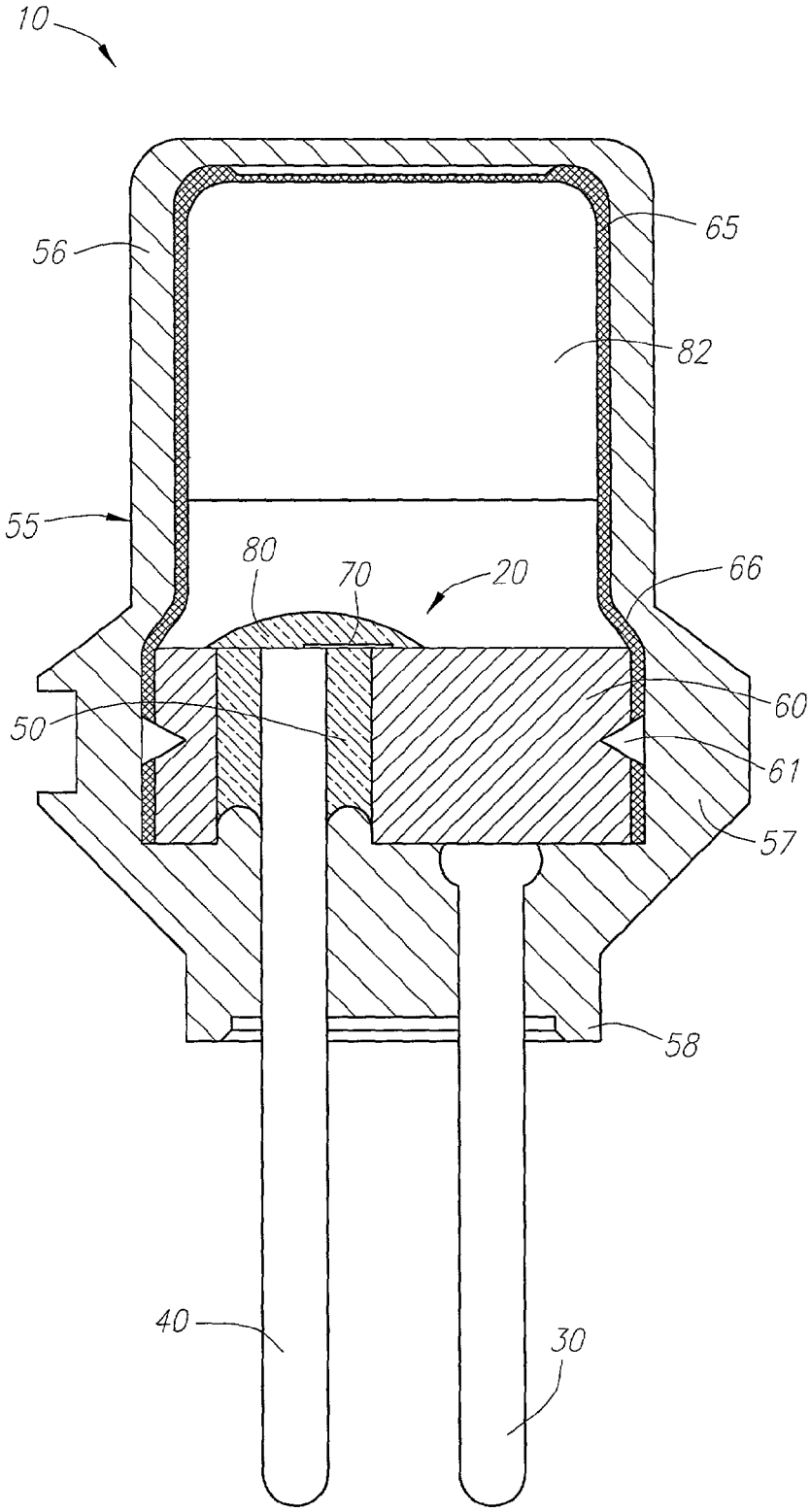
10
56
65
82
55
80
70
20
66
60
50
61
57
58
40
30

OVERMOLDED BODY FOR PYROTECHNIC INITIATOR AND METHOD OF MOLDING SAME

BACKGROUND OF THE INVENTION

The present invention generally relates to the field of molding, and more particularly to a pyrotechnic initiator having an integral, unitary, overmolded body.

Pyrotechnic initiators have many uses in industrial and consumer applications. One important use is in triggering the inflation of airbags in motor vehicles. Significant efforts have been made in the automotive industry to reduce the cost of manufacturing reliable airbag initiators. One advance has been the molding of insulating bodies around parts of initiators. There remains a substantial need for further reduction in the costs of manufacturing reliable initiators, however, and hitherto, an integral, unitary, overmolded body has never been provided on an initiator.

SUMMARY OF THE INVENTION

In accordance with the present invention, a pyrotechnic initiator is provided that includes an integral, unitary, overmolded body, eliminating the need for separate components to form the body, such as a separate insulator cup.

BRIEF DESCRIPTION OF THE FIGURE

The FIGURE is a side sectional view of an embodiment of the present invention.

DETAILED DESCRIPTION OF A PREFERRED EMBODIMENT

Referring to the FIGURE, a preferred embodiment of an initiator 10 according to the present invention consists of an initiator subassembly surrounded by an integral, unitary, overmolded body 55.

In the depicted embodiment, the initiator subassembly comprises a header assembly 20 hermetically attached (by through-weld 61) to a can 65 loaded with an output pyrotechnic charge 82. The header assembly 20 in turn consists of a header, a bridgewire 70 that is welded to the header, and an ignition pyrotechnic charge, droplet 80 that is disposed around bridgewire 70. The header comprises a ground pin 30, an isolated center pin 40, glass 50, and an eyelet 60, with the pins 30 and 40 projecting out to form the connector end of the initiator subassembly. While this particular exemplary configuration of initiator subassembly is shown and described in detail, it will be readily apparent that various configurations of initiator subassembly can be used or modified appropriately for use, in the present invention.

In accordance with the invention, body 55 is molded onto an appropriate initiator sub-assembly, such as the one depicted in the FIGURE. While other methods of molding or forming may be used to mold body 55, insert injection molding is preferable. In that method, the initiator subassembly is inserted into a mold tool that includes a means for holding the initiator subassembly in an appropriate position, a cavity shaped to define the outer surface of body 55, openings for the pins 30 and 40, and one or more injection ports into the cavity. A suitable molten polymer, preferably nylon, is then injected through the port(s) into the cavity and around the initiator subassembly. The injection port or ports may be positioned near the upper region 56 of body 55, so that the injected molten material flows downward. Alternately, the molten material may be injected elsewhere, such as into the "biconical" region 57 of body 55, although this may require that pins 30 and 40 be clamped down more firmly in the mold tool. The molten polymer is then allowed to cool and harden to form body 55, the mold is opened, and the completed initiator is removed.

In any case, the cross-sectional thickness of the wall of the upper region 56 of body 55 (which is created between the outside of the initiator subassembly and the cavity defined in the mold) should be great enough to permit adequate molten material flow during injection. Since the overall outer diameter of the initiator must conform to customer specifications and cannot be arbitrarily increased, the upper portion of can 65 in the depicted configuration is narrowed to permit a corresponding increase in the thickness of the wall of upper region 56 of body 55. Since the header assembly of this particular initiator subassembly remains larger in diameter than the upper region of can 65, however, a circumferential flare 66 is provided toward the bottom of can 65, so that the lower portion of can 65 accommodates the header.

It should be noted that since injection molding is generally performed under rather high pressures, the walls of can 65 should be of a suitably strong material, and have a sufficient cross-sectional thickness, to minimize any possibility of the can crushing under that pressure. This possibility can be further avoided by filling the can sufficiently with output charge 82 to bolster the strength of the can against compression.

Since body 55 is preferably nonconductive, it inhibits stray current from flowing through the initiator by any path other than through pins 30 and 40, thereby providing added protection against accidental ignition of the initiator. Consequently, body 55 should cover substantially all of the initiator subassembly, except for the exposed end portions of pins 30 and 40, which preferably project past the end portion 58 of body 55. End portion 58 could extend further, however, and/or, if a "female" configuration were desired, the exposed end portions of pins 30 and 40 could be recessed within body 55 (preferably with some modification to the ends of the pins).

Body 55 also provides structural support for, and defines the outside features of, the initiator. Specifically, body 55, and in particular its end portion 58, preferably acts as a guide for an external connector formed to mate with the exposed end portions of pins 30 and 40. Thus, body 55 is preferably molded to be compatible with a standard automotive connector, such as an AMPHENOL®-compatible connector, or a serviceable or non-serviceable integral connector.

A preferred embodiment of an overmolded body for a pyrotechnic initiator, and many of its attendant advantages, has thus been disclosed. It will be apparent, however, that various changes may be made in the form, construction, and arrangement of the parts without departing from the spirit and scope of the invention, the form hereinbefore described being merely a preferred or exemplary embodiment thereof. Therefore, the invention is not to be restricted or limited except in accordance with the following claims.

What is claimed is:

1. An automotive pyrotechnic initiator, comprising:

a) an initiator subassembly including a can loaded with a pyrotechnic charge, and a header assembly having an igniter wire and a connector end; and, b) a molded, integral, unitary electrically-nonconductive overmoloed body connected to and surrounding substantially all of said initiator subassembly except for an exposed portion of said connector end, wherein said body provides structural support and installation orientation features.

2. The initiator of claim 1, wherein said connector end of said header aooembly comprises two electrode pins.

3. The initiator of claim 2, wherein said electrode pins project outwardly from said body.

4. The initiator of claim 3, wherein one of said electrode pins is a ground pin and the other is an isolated electrode pin.

5. The initiator of claim 4, wherein said body and said electrode pins together form a serviceable or non-serviceable integral automotive airbag initiator connector.

6. The initiator of claim 5, wherein said header assembly is a glass-to-metal sealed header assembly.

7. The initiator of claim 6, wherein said body is made of nylon.

8. The initiator of claim 1, wherein said body is made of nylon.

9. The initiator of claim 1, wherein said header assembly is a glass-to-metal sealed header assembly.

10. A method for making an automotive pyrotechnic initiator having an overmolded body, comprising the steps of:

a) providing an initiator subassembly including a can loaded with a pyrotechnic charge, and a header assembly having an igniter wire and a connector end; and, b) molding an integral, unitary, electrically-nonconductive, nonconductive, overmolded body around said subassembly, such that said body is connected to and surrounds substantially all of said initiator subassembly except for an exposed portion of said connector end, wherein said body provides structural support and installation orientation features.

11. The method of claim 10, wherein said step of providing includes providing an initiator subassembly wherein said connector end at said header assembly comprises two electrode pins.

12. The method of claim 11, wherein said step of providing includes providing an initiator subassembly that includes a ground pin and an isolated electrode pin.

13. The method at claim 11, wherein said step of molding includes molding said body such that an exposed portion of each of said electrode pins projects outwardly from said body.

14. The method of claim 11, wherein said step of molding includes injecting molten material into a mold in which said initiator subassembly is placed.

15. The method of claim 14, wherein said step of molding includes injecting molten material into said mold under pressure.

16. The method of claim 15, wherein said step of providing includes providing an initiator subassembly wherein said can is tightly and substantially completely loaded with said pyrotechnic charge.

17. The method at claim 14, wherein said step of providing includes providing an initiator subassembly having an upper region, and wherein said step of molding includes injecting said molten material at said upper region of said initiator subassembly, and allowing said molten material Lo flow downwardly a long said subassembly.

18. The method of claim 17, wherein said step of molding includes injecting molten material into said mold under pressure.

19. The method of claim 17, wherein said header assembly a glass-to-metal sealed header assembly.

20. The method at claim 10, wherein said step of molding includes injecting molten nylon.

* * * * *